United States Patent [19]

Faulkner

[11] Patent Number: 4,777,898

[45] Date of Patent: Oct. 18, 1988

[54] PONTOON LOG BODY AND METHOD FOR PRODUCING SAME

[75] Inventor: James R. Faulkner, Lebanon, Mo.

[73] Assignee: Lowe Industries, Lebanon, Mo.

[21] Appl. No.: 89,921

[22] Filed: Aug. 25, 1987

Related U.S. Application Data

[63] Continuation of Ser. No. 836,830, Mar. 6, 1986, abandoned.

[51] Int. Cl.[4] ..... B63B 3/04

[52] U.S. Cl. ..... 114/61; 114/88; 114/292; 114/357

[58] Field of Search ..... 114/61, 88, 292, 355, 114/356, 357, 358, 65 R; 441/44, 45; 403/338; 29/463; 428/343

[56] References Cited

U.S. PATENT DOCUMENTS

| | | | |
|---|---|---|---|
| 3,083,382 | 4/1963 | Havens et al. | 114/61 |
| 3,133,294 | 5/1964 | Kunz | 114/357 |
| 3,383,720 | 5/1968 | Greig et al. | 114/357 |
| 3,731,644 | 5/1973 | Bradt | 114/61 |
| 3,760,439 | 9/1973 | Swenson, Sr. | 114/356 |
| 3,806,972 | 4/1974 | Jackowski | 114/357 |
| 4,169,184 | 9/1979 | Pufahl | 428/343 X |

FOREIGN PATENT DOCUMENTS

| | | | |
|---|---|---|---|
| 2109871 | 9/1972 | Fed. Rep. of Germany | 114/357 |

*Primary Examiner*—Sherman D. Basinger

[57] ABSTRACT

A method for forming a pontoon log and the pontoon log formed thereby. The method includes the steps of forming the pontoon log body including a flange; applying sealing tape to the flange; covering the body with a top member, the top member including a second flange or flange portion, with the sealing tape intermediate opposing flanges; driving a clip onto opposing flanges; and securing the clip to the flanges and through the sealing tape, thereby forming a pontoon log able to receive additional fasteners through the clip, opposed flanges and sealing tape without destroying a waterproof seal formed between the pontoon log body and top member.

9 Claims, 2 Drawing Sheets

FIG. 1.
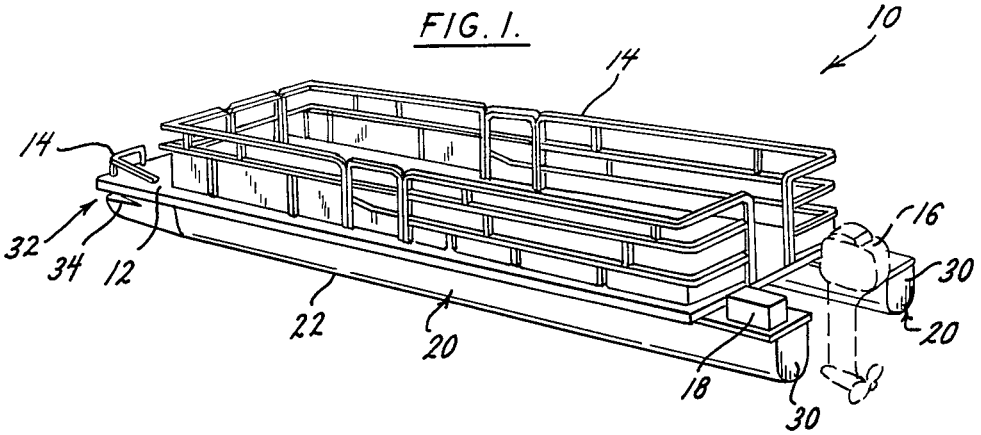
FIG. 2.
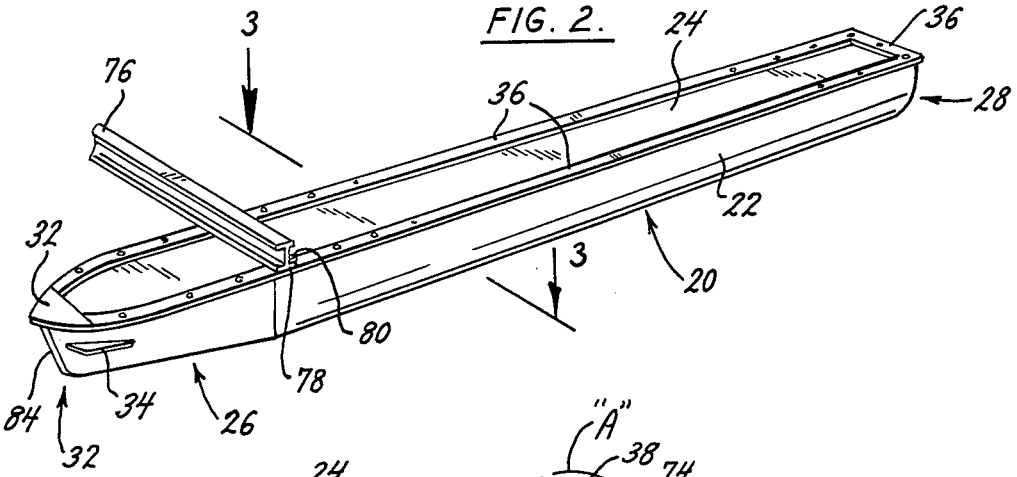
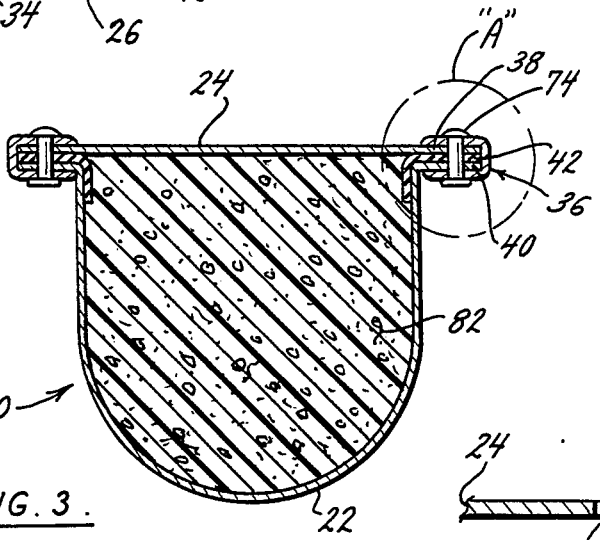
FIG. 3.
FIG. 4.
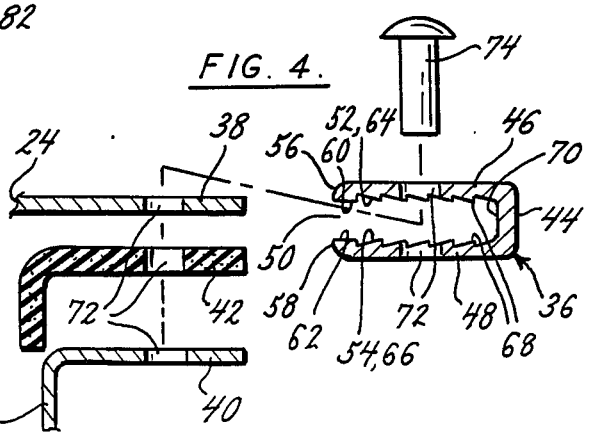

PONTOON LOG BODY AND METHOD FOR PRODUCING SAME

This is a continuation of co-pending application Ser. No. 836,830 filed on Mar. 6, 1986 and now abandoned.

BACKGROUND OF THE INVENTION

This invention relates generally to a flotation device such as a pontoon log and more particular to a method of manufacturing the device which provides for structural connections between the device and a structure it supports without destroying the watertight integrity of the flotation device.

Pontoon boats, otherwise known as pontoons, using pairs of pontoon logs as flotation devices are a popular recreational water item. At least six manufacturers of pontoons compete for this segment of the water recreation equipment industry. Pontoon boats are used for a number of water sports including skiing and fishing.

Among the present manufacturers of pontoons two approaches are generally taken with respect to the assembly of the pontoon logs. Some of the manufacturers use a generally cylindrical log that must be formed by welding a number of cylindrical sections and end pieces together to form the pontoon log. Other manufacturers use a pontoon log having a generally hull-shaped body with a flat top portion. According to present methods the pontoon log is manufacturered by welding the hull-shaped lower section or body and the flat top section together.

The pontoon logs, no matter their shape, are attached to a pontoon deck by intermediate structural members spanning between the pontoon logs in pairs, threes or the number required to accomodate the size or intended purpose of the pontoon.

At present, in order to assure the watertight integrity of the pontoon log, each penetration of the pontoon log for connection with the intermediate structural member must be caulked after attachment. Thus, each of the rivets, bolts and the like used to attach the pontoon log and pontoon deck together by means of the intermediate structural member results in a hole in the pontoon log requiring caulk. In order to insure the water tight integrity of the pontoon log, the bolts are normally caulked by hand. The existing method and resulting pontoon log are expensive and labor intensive and success cannot be guaranteed in view of the need for manual application of the caulk.

Although it is not nnknown to use a rivet and gasket form of construction for boat hulls in lieu of welding, this method has not found acceptance for use with pontoon logs. The closest known construction of this sort is that revealed by U.S. Pat. No. 3,133,294 which discloses a plastic boat including a plastic hull and deck plate with a gasket sandwiched therebetween and a riveted frame member holding the parts together by conventional connection means. In this form of construction the plastic and frame member are held together by the rivets.

The present pontoon log and method for making the pontoon log solves these and other problems in a manner not disclosed in the known prior art.

SUMMARY OF THE INVENTION

The pontoon log of the present invention provides a flotation device readiy attachable to a deck structure to form a pontoon boat. The deck structure and pontoon logs may be attached to an intermediate structural member such as an aluminum stringer, for example, a channel member or I-beam. By means of the present invention the intermediate structural member may be attached to the pontoon log without further need for hand caulking where the attachment means, commonly a bolt and flange washer, pierce the pontoon log.

The method for manufacturing a sectional pontoon log can be used for any sectional pontoon log including any hull shaped log formed with a widened edge or other connection portion, for example, a flange on each section to which a sealing means such as an adhesive coated length of sealing tape may be applied. The sections are joined such that the sealing means lies at least between the widened edges of the adjoining sections. A securing means is driven onto the connection portions of the now adjoining sections to further drive the adjoining sections together. The pontoon log sections are further secured by use of a number of fastening means, such as rivets, placed through the securing means and the intermediate connections portions and sealing means. The latter attachment operation does not require further caulking of the fastening means penetrations.

The intermediate structural members may be attached to the connection portions of the adjoining pontoon log sections. In a preferred embodiment a threaded bolt and flange washer are used. These additional penetrations or openings required for the attachment of the intermediate structural member do not need further caulking since the penetrations are sealed by the surrounding sealing means.

It is an aspect of this invention that the sectional flotation device provides a buoyant flotation structure.

It is another aspect of the invention that a method is provided for manufacturing a buoyant flotation structure having a number of sections.

It is an aspect of this invention that the sealing means is provided by compressible sealing tape.

It is another aspect of the invention to provide a securing means in the form of a U-shaped elongate clip having flanges spaced apart a distace less than the combined thickness of the connected sections and uncompressed sealing tape.

Still another aspect of the invention is to provide a structure have a surface to which additional, structural members can be readily attached without destroying or diminishing the buoyancy assured by the integrity of the waterproof seal.

Another aspect of the method of the present invention is insuring a waterproof seal in the event that additional attachments are required after the flotation device itself has been manufactured and assembled.

Still another aspect of the present invention is to provide a sectional flotation device providing a pontoon log readied for attachment to a pontoon boat deck by means of an intermediate structural support member. For example, a number of aluminum stringers support a deck stucture on a plurality of pontoon logs, without the need for tedious, manual caulking of the additional fasteners between the support member and the pontoon logs in order to assure watertight integrity of the pontoon logs.

Another aspect of the present invention provides a pontoon log having an uncomplicated structure, easily and economically assembled with standard materials.

It is another aspect of the method of this invention to provide an uncomplicated method of manufacture for ease of assembly while still providing a high quality product with better waterproof integrity then that presently available on known structures manufactured by known methods.

These and other objects and features of the present invention will be better understood and appreciated from the following detailed description of one embodiment thereof, selected for the purpose of illustration and shown in the accompanying drawings.

BRIEF DESCRIPTION OF THE DRAWINGS

FIG. 1 is a perspective of a pontoon boat showing the relationship between a pontoon log embodying the present invention and the deck structure of the pontoon boat;

FIG. 2 is a perspective view of a pontoon log embodying the present invention showing one location of an intermediate structural member;

FIG. 3 is a cross-sectional view along line 3—3 of FIG. 2;

FIG. 4 is an exploded enlargement of portion "A" in FIG. 3;

DESCRIPTION OF A PREFERRED EMBODIMENT

Figure 5:
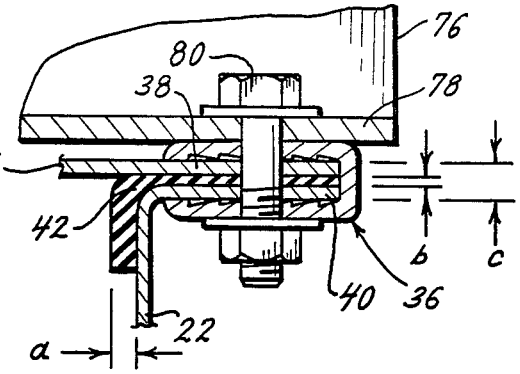
FIG. 5 is similar to FIG. 4 but illustrates the attachment of an intermediate structural member.

Referring now by characters of reference to the drawings and first to FIGS. 1 and 2 it will be understood that a pontoon boat or pontoon as it is normally called, generally indicated by reference character 10, is intended for use in various recreational water activities, and generally includes a deck 12 having deck rails 14 and a rearward mounted outboard motor 16 with associated fuel supply 18. An inboard motor option is available for some pontoon models.

The pontoon is buoyantly supported on the water by means of pontoon logs 20. Although the majority of pontoons have two pontoon logs it is common in the industry to provide three or more pontoon logs depending upon the size of the pontoon boat, where and how the pontoon will be used.

Pontoons are generally propelled by anywhere from a 40 horsepower to a 120 horsepower outboard motor. Some pontoons, as previously indicated, include an inboard motor, but in any event, both the motor and fuel supply are normally mounted at the rear of pontoon deck 12.

Referring now to FIG. 2 it will be understood that pontoon log 20 generally includes a generally hull-shaped pontoon log body 22 and a generally plate shaped pontoon log top 24 as shown in the drawings. In the preferred embodiment the pontoon log includes two aluminum sections and the log body includes opposing, upwardly extending sides.

Figure 6:
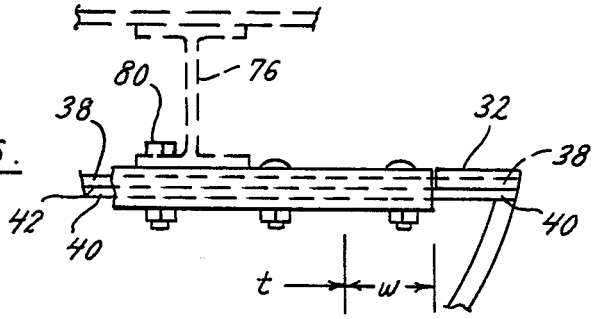
FIG. 6 is an enlarged elevation of a portion of the prow section of a preferred embodiment of the pontoon log.

Pontoon log 20 includes a prow section 26 and aft section 28. A transom board 30 defines the aft end of pontoon log body 22. FIG. 6 illustrates a nose casting member 32 joined to the pontoon log 20 at the prow section 26 for additional strength. Splash diverter 34 deflects spray away from the deck 12 to provide a dryer and more pleasant ride for occupants of pontoon boat 10.

Figure 6A:
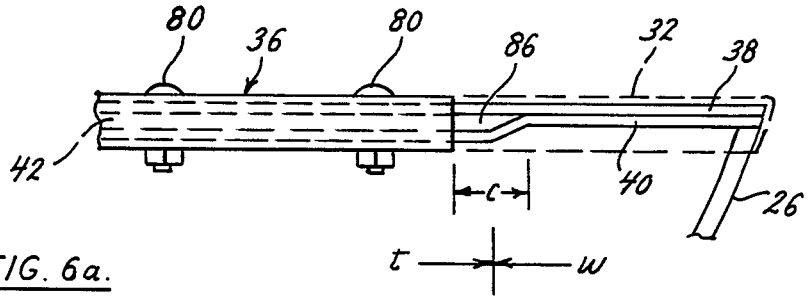
FIG. 6*a* is a modified prow section of FIG. 6 shown exaggerated to illustrate another embodiment of the pontoon log of the present invention.

Previously, the pontoon log top and pontoon log body were joined by welding the two together along the entire perimeter. In a preferred embodiment of the present invention welding is generally limited to joining the nose casting 32 to the prow section of pontoon log 20. The welded portion shown in FIG. 6 is indicated by the "w" while the portion labeled "t" indicates the location of a sealing tape, as discussed below. The present invention discloses a pontoon and a method of manufacturing the pontoon which does not require substantial welding and which provides a waterproof seal without the substantial welding previously required. It is well known to those skilled in the art to weld nose castings onto pontoons. In fact it is well known to those skilled in the art to weld the entire pontoon assembly together, i.e., hull and top plate as previously discussed. If the welding is limited to the nose casting, then there must be a limit to the welding. Thus, FIGS. 6 and 6*a* are intended to suggest to those already skilled in the art and already knowledgeable with respect to welding techniques that there is a practical limit to the welding (FIG. 6) and that a caulk (C) could be used as a transition between the tape and the weld (FIG. 6*a*). Caulk is a well known sealing means to those skilled in the art. The dashed lines in FIG. 6*a*illustrate that the flange portions 38 and 40 extend to the prow section 26 as shown in FIG. 6. The nose casting 32 provides a pontoon log that is better able to withstand impact with floating debris, rocks, piers and the like.

As will clearly be seen from FIGS. 3–5, a securing means; in a preferred embodiment an alongate clip 36, is instrumental for maintaining waterproof integrity and a water impervious seal between the pontoon log body 22 and the pontoon log top 24. The pontoon log body 22 and top 24 include opposing connection portions, for example, top flange 38 and a body flange 40, respectively.

The present invention teaches connected sections of the flotation device or pontoon log including at least one connection portion registerable with the adjoining connection portion of the adjacent section when the two sections are placed in position for connection to each other. In a preferred embodiment the connection portion of the pontoon log body is flange portion 40 and the connection portion of the pontoon log top is flange 38 about the perimeter of pontoon log top 24.

In a preferred embodiment a sealing means, in the form of a continuous sealing tape 42, is placed on the upper facing surface of the flange 40. In a preferred embodiment the sealing tape is a PVC foam sealing tape having adhesive on at least one side for adhering the tape to the flange during assembly. As shown in FIGS. 3–5, the sealing tape may extend past an inner edge of flange 40 and continue down the upwardly extending side for a short distance for ease of installation. The adhesive, however, is not necessary to the invention. One preferred tape is an off-the-shelf item manufactured by the Minnesota Minning and Manufacturing Company and readily obtainable.

The sealing tape, although preferred, is not the only suitable material. For example, it is believed that certain sealing materials that are applied in paste or gel form will function as well as the sealing tape illustrated in the preferred embodiment.

The elongate clip 36 provides securing means for forcibly joining top flange 38 and body flange 40, in a preferred embodiment, as indicated in FIGS. 3 and 5. Clip 36, as illustrated in the disclosed embodiment, has a generally U-shaped cross section. The clip is preferably an aluminum extrusion having a first opposing flange 46 and a second opposing flange 48 forming a channel 50. It should be understood that clip 36 in the disclosed embodiment extends almost the entire perimeter of pontoon log 20 except for the prow section 26 as discussed above.

A preferred embodiment of clip 36 is clearly illustrated in FIGS. 4 and 5. In addition to the elements already described, the preferred embodiment includes a first opposing surface 52 and a second, opposing surface 54. The opposing flanges 46 and 48 have a first flange free edge 56 and a second flange free edge 58, respectively. The free edges are directed towards the pontoon log 20 during assembly and driven on over the top flange 38 and body flange 40, thereby driving the two flanges together between the flange free edges and opposing surfaces.

Entry of top flange 38 and bottom flange 40 into channel 50 is made easier by the configuration of opposing flanges 46 and 48. In a preferred embodiment, clip 36 includes a first smooth leading surface 60 and an opposing, second smooth leading surface 62. Once flanges 38 and 40 have entered channel 50 they contact first sawtooth surface 64 and opposing, second sawtooth surface 66, which sawtooth surfaces tend to hold clip 36 on the flanges 46 and 48 due to the resistance created by backward facing teeth 68. In a preferred embodiment the clip extends over flanges 46 and 48 until contacting base interior surface 70.

The sawtooth feature of clip 36, as described above, provides a gripping means for securing the elongate clip over flanges 38 and 40. The combination of the gripping feature of the sawteeth and the greater thickness of the flanges and sealing tape relative to the channel 50 also acts to secure the clip. The opposing sawteeth surfaces 64 and 66 engage the adjacent flange surfaces tending to hold the clip in its desired position.

A hole 72 may be drilled, punched or otherwise formed through assembled members 46, 38, 42, 40 and 48, respectively, to provide for insertion of a fastening means through the assembled members for further fastening the clip 36 to pontoon log 20. In one preferred embodiment, as illustrated in FIGS. 3–5, a plurality of rivets 74 inserted through the assembly form respective receiving holes 72 and fasten the assembly upon deformation of the rivets. The assembly comprises clip 36, top flanges 38, body flange 40 and sealing tape 42 as illustrated in FIGS. 3–5.

Prior to connection of the pontoon log top to the pontoon log body in one embodiment, foam flotation blocks 82 are placed within the pontoon log for additional buoyancy and added safety.

Now having identified the structure of the pontoon log it is considered important to further point out the advantageous manner in which a number of structural members such as aluminum stringers 76 can be attached to the pontoon log for supporting deck 12 as particularly illustrated in FIGS. 2, 4, 5 and 6.

A stringer generally includes two flanges and a web portion. This structural member could be a channel member, an I-beam or other suitable member. In the illustrated embodiment a flange 78 is attached to the pontoon log, as by attachment means such as the bolt 80 thereby forming the supporting structure for the pontoon deck.

In actual practice the exact location of the attachment means for attaching the stringer or other support member to the pontoon log cannot be determined before actual assembly takes place. Therefore, as illustrated in FIG. 5, no matter where the attachment means for attaching the stringer to the pontoon log might be located, the sealing tape provides and insures the waterproof integrity of the pontoon log since the sealing tape can be pierced at nearly any spot along its length and still remain in sealing relationship with the top flange 38 and bottom flange 40. Similarly, equivalent sealing means provide the same feature.

The initial step to the method of the present invention is forming the pontoon log body. An aluminum sheet is bent into a generally hull-shaped configuration. A nose or prow section and a transom board are attached to or formed in the hull-shaped stucture in order to form opposing ends of the pontoon log body. In a preferred embodiment an outwardly extending flange 40 is formed along the opposing longitudinal edges of the pontoon log body. It will be appreciated that in other combinations of sections for forming a flotation device a sufficiently widened edge portion could satisfy the flange requirement.

In a preferreded embodiment a PVC foam sealing tape 42 with adhesive on at least one side is applied adhesive side down to the upper surface of flange 40. Pontoon log top 24 with its top flange 30 is placed such that the sealing means is between the flanges. The sealing tape could be any commercially available tape with single-sided adhesive, double-sided adhesive or without adhesive. The sealing means is not limited to tapes. Caulks, gels, pastes and the like are now available that cure to form tape or caulk-like material and they are also suitable to practice the present invention.

The sections to be connected are place in the desired adjacent relationship. Clip 36 is forced onto the flanges in order to secure the now adjacent flanges 38 and 40 against each other and both against the sealing means. Sufficient force is required to overcome the resistance provided by the combination of the opposing flanges of the clip and the fact that channel 50 is preferably narrower than the thickness of the flange and sealing means assembly so that the flanges provide gripping means holding the assembly together.

In a preferred embodiment channel 50 is approximately 0.170 inches wide. The width of channel 50 is designated as dimension "c" in FIG. 5. The dimensions of clip 36 do not change significantly when the clip is forced into position over flange portions 38 and 40. The flanges are approximately 0.063 inches and 0.086 inches thick, respectively. In this particular embodiment, sealing tape 42 is approximately 0.063 inches thick when applied to the assembly and then compressed to approximately one-third of its original thickness, or obout 0.021 inches thick, with the application of clip 36. The uncompressed and compressed thicknesss of the sealing tape are designated as dimensions "a" and "b", respectively. The backward facing teeth 68 act to further hold the final assembly together and enhance the gripping action.

Fastening means, such as rivets 74, are placed through the flanges and sealing tape. The sealing tape allows the rivets to pierce the structure as shown in FIG. 5 without destroying the waterproof integrity of the pontoon log.

The method of the present invention further includes the attachment of an intermediate structural member such as an aluminum stringer to the flanges and through the clip. As previously discussed, the stringer forms the support, joint or bridge between the deck and the pontoon log and between associated pontoon logs. The attachment means used, such as bolts and nuts in a preferred embodiment, may pierce the clip, flanges, and tape or its equivalent in any number of desired locations without destroying the waterproof integrity and thus the buoyancy of the pontoon log. FIG. 6a illustrates a modified prow section in which caulk (c) indicated by 86 is applied as a transition between the tape 42 (t) and the welded (w) portion.

From the foregoing description those skilled in the art will appreciate that all of the aspects in the present invention are realized. The waterproof assembly provides the desired buoyant structure. The present invention is readily applicable to multi-section flotation devices as long as there are adequate opposing connection portions. The use of the sealing means provides a seal around any rivets, bolts and the like that pierce the sealing means and adjacent assembly. The present invention does not require tedious, expensive and often faulty manual caulking of each rivet, bolt and the like. Instead, all fastening and attaching steps may be accomplished without concern about the effect on waterproof integrity of the present invention. Furthermore, the manufacture of the present invention requires significantly less of the difficult and expensive welding of exotic materials such as aluminum, the material generally used to manufacture pontoon logs, when compared with existing methods of manufacture.

While a specific embodiment has been shown and described, many variations are possible. The particular shape of the pontoon log body and pontoon log top may be changed as desired to suit the pontoon or other water craft with which it is used. The sealing means may vary although sealing tape is preferred. The particular shape of clip 36 may be changed as desired to suit the shape or configuration of sections, connection portion or flanges to be joined.

Other modifications may be made to the embodiment illustrated and described without departing from the spirit of the invention. It is not intended that the scope of this invention be limited to a particular embodiment. Rather, the scope of the invention is to be determined by the following claims and their equivalents.

I claim as my invention:

1. A method for manufacturing a flotation device comprising the steps of:

(a) forming a pair of water impervious sections including a generally hull-shaped body section and top plate section, (b) forming at least one connection portion on each section, including a perimeter flange on the generally hull-shaped body section and a flange portion on the perimeter of the top plate section, (c) placing adjoining sections with their respective connection portions in opposition, (d) applying sealing means intermediate opposing connection portions, (e) joining the sections with the sealing means intermediate joined connection portions, (f) forcing elongate securing means generally parallel to the perimeter flange and the flange portion and over opposing connection portions and intermediate sealing means and thereby compressing the sealing means, (g) providing the elongate securing means with gripping means for holding the elongate securing means in position over opposing connection portions, the elongate securing means including a generally U-shaped clip, the gripping means including a gripping sawtooth surface whereby the gripping sawtooth surface tends to hold the elongate securing means in place over the opposing connection portions, and (h) securing the adjacent sections with fastening means placed through the securing means, opposing connecting portions and intermediate sealing means.

2. A method for manufacturing a flotation device as set forth in claim 1, further including the step of:

(i) applying a sealing tape intermediate opposing connection portions to provide the sealing means.

3. A method for manufacturing a sectional flotation device as set forth in claim 1, further including the step of:

(i) fastening a structural member to the device with fastening means placed through the securing means, opposing connection portions and intermediate sealing means without destroying the waterproof seal formed by opposing connection portions and intermediate sealing means.

4. A flotation device comprising:

(a) a pair of water impervious sections including a generally hull-shaped body section and an adjoining top plate section, (b) at least one connection portion on each section, the generally hull-shaped body including a perimeter flange and the top plate section including a flange portion, (c) adjoining sections having their respective connection portion in opposition, (d) sealing means intermediate opposing connection portions, (e) elongate securing means forced over opposing connection portions and intermediate sealing means, thereby reducing the thickness of the combination of opposing connection portions and intermediate sealing means, (f) the elongate securing means including gripping means for holding the elongate securing means in positions over opposing connection portions and intermediate sealing means, the elongate securing means further including a generally U-shaped clip having a gripping sawtooth surface engaging the opposing connection portions, whereby the clip, forced over the opposing connection portions and intermediate sealing means generally parallel to the perimeter flange and the flange portion, tends to grip the opposing connection portions and hold the generally U-shaped clip in place, and (g) fastening means placed through securing means, opposing connection portions and intermediate sealing means, whereby the waterproof seal formed by the opposing connection portions and intermediate sealing means is not destroyed even though the fastening means pierce.

5. A flotation device as set forth in claim 4, further including:

(h) a structural member attached to the device with attachment means placed through the securing means, opposing connection portions and intermediate sealing means without destroying the waterproof seal formed by the opposing connection portions and intermediate sealing means.

6. A flotation device as set forth in claim 4, wherein the sealing means comprises:

(h) a compressible sealing tape, having an adhesive on at least one surface.

7. A pontoon boat formed from a pair of flotation devices, each device comprising:

(a) a hull-shaped body having an outwardly extending peripheral flange, (b) a top plate having a peripheral flange disposed adjacent the flange of the hull-shaped body, (c) compressible foam sealing tape disposed substantially continuously intermediate the adjacent flanges, (d) an elongate U-shaped securing clip having opposed sawtooth flanges spaced apart at distance less than the combined thickness of the adjacent flanges and the uncompressed foam sealing tape prior to engagement with the adjacent flanges, said sawtooth flanges having backward facing teeth to facilitate driving said clip generally parallel to the adjacent flanges into securing engagement and retaining said clip in position, and (e) a plurality of rivets disposed at spaced intervals along the flanges to fasten the clip in position.

8. A pontoon boat as set forth in claim 7, wherein:

(f) a nose member is provided for each prow section, (g) the clip extends substantially to the nose member and the sealing tape is longitudinally spaced from the nose member and the top plate is welded to the flange along the tapeless space.

9. A pontoon boat formed from a pair of flotation devices, each device comprising:

(a) a hull-shaped body having an outwardly extending peripheral flange, (b) a top plate having a peripheral flange disposed adjacent the flange of the hull-shaped body, (c) compressible foam sealing tape disposed substantially continuously intermediate the adjacent flanges, (d) an elongate U-shaped securing clip having opposed sawtooth flanges spaced apart a distance less than the combined thickness of the adjacent flanges and the uncompressed foam sealing tape, said sawtooth flanges having backward facing teeth to facilitate driving said clip into securing engagement and retaining said clip in position.

(e) a plurality of rivets disposed at spaced intervals along the flanges to fasten the clip in position, (f) the assembled flanges, sealing the tape and clip of each flotation device include a plurality of openings extending therethrough, (g) a plurality of transverse members having corresponding openings extend between the flotation devices, and (h) a plurality of bolt fasteners connect said transverse members to said flotation device.

* * * * *